United States Patent [19]

Schuler et al.

[11] Patent Number: 4,553,411

[45] Date of Patent: Nov. 19, 1985

[54] STAMPED KNITTING TOOL FOR KNITTING MACHINES

[75] Inventors: Bernhard Schuler, Sonnenbühl; Ernst Beck, Bitz, both of Fed. Rep. of Germany

[73] Assignees: Theodor Groz & Söhne; Ernst Beckert Nadelfabrik KG, both of Albstadt, Fed. Rep. of Germany

[21] Appl. No.: 658,060

[22] Filed: Oct. 4, 1984

Related U.S. Application Data

[63] Continuation of Ser. No. 254,030, Apr. 14, 1981, abandoned.

[30] Foreign Application Priority Data

Apr. 17, 1980 [DE] Fed. Rep. of Germany ..... 3014751

[51] Int. Cl.[4] ..... D04B 35/02

[52] U.S. Cl. ..... 66/123; 66/121

[58] Field of Search ..... 66/116, 121, 123

[56] References Cited

U.S. PATENT DOCUMENTS

| | | | |
|---|---|---|---|
| 3,748,875 | 7/1973 | Slof et al. | 66/123 |
| 4,036,036 | 7/1977 | Ashmead et al. | 66/123 |
| 4,068,500 | 1/1978 | Kohorn | 66/123 |
| 4,089,192 | 3/1978 | Kohorn | 66/123 |

*Primary Examiner*—Ronald Feldbaum

*Attorney, Agent, or Firm*—Collard, Roe & Galgano

[57] ABSTRACT

A stamped knitting tool for knitting or weaving machines is provided having a shank which is provided with at least one foot and at least two guide portions which extend down to the lower region of the shank. These guide portions are connected above the lower region of the shank by means of a rib thereabove having a width of at least 1.1 mm and at least one of the guide portions supports the foot. The tool is further characterized in that a lower rib of about equal width is provided along the lower region of the shank.

1 Claim, 3 Drawing Figures

STAMPED KNITTING TOOL FOR KNITTING MACHINES

REFERENCE TO RELATED APPLICATIONS

This is a continuation application of application Ser. No. 254,030, filed Apr. 14, 1981 now abandoned, for STAMPED KNITTING TOOL FOR KNITTING OR WEAVING MACHINES.

FIELD OF THE INVENTION

The invention relates to a stamped knitting tool for knitting machines. More particularly, it relates to such a tool having a shank which is provided with at least one foot and at least two guide portions, at least one of which supports the foot, which extend down to the lower part of the shank and which are connected above the lower part of the shank by means of a rib above the lower portion of the shank which has a height of at most 1.1 mm. Knitting tools of the aforementioned type include latch needles, slide needles and plates with or without latches, for example, shag tools for making shag goods.

BACKGROUND OF THE INVENTION

Such a needle which is known from German Offenlegungsschrift 28 20 925 is based on the realization that, if the height of the rib or web is so limited and the minimum length of an unsupported rib or web section is at least 8 mm, the control impacts exerted by the needle lock on the foot of the needle are converted into bending vibrations on their way to the hooked-shaped end, i.e., the head of the needle, and are so damped that no breakage of the hook will occur, thereby increasing the operating life of the needle. Because of the ready flexibility of the rib or web sections obtained by this dimensioning, the bending force exerted by the control impacts on the foot of the needle is converted in the rib or web sections primarily into bending vibrations, whose amplitude is located in the plane of symmetry of the needle. For this reason, the web is positioned above the lower part of the shank, so that there is not obstacle at the bottom of the needle slot of the bed or the cylinder grooves.

The present invention is based on the realization that the aforementioned knitting tool is limited in its stability and does not withstand any strong stresses. Such stronger stresses may be caused, under certain circumstances, by the thread which is under tension, as a result of which a stretching of the knitting tool on the guide portion (displacement spot) may occur. During the operation of crossing needles (cylinder and rib needles), a resistance force transverse relative to the needle axis is exerted by the crossing needle, so that a bendable soft needle would not withstand such a force and the danger exists that the needle may be removed from the channel or conduit base. Generally, impairments in the stability of the knitting tools occur with increasing length, in particular, when providing a second foot for creating designs or patterns.

The subject invention is further based on the realization that, in contrast to the statement made in German Offenlegungsschrift 28 20 925, at col. 9, second para., that a free-standing disposition of the foot affords the best results, an arrangement wherein at least one of the guide portions supports the foot is particularly advantageous.

It is therefore an object of the invention to provide an improved needle of the aforementioned type wherein the needle stability is strengthened, while simultaneously all the advantageous characteristics of such a needle are maintained.

SUMMARY OF THE INVENTION

In accordance with the invention, this object of the invention is obtained in a needle of the aforementioned type wherein a bottom or lower rib of a somewhat lower height is provided along the lower portion of the longitudinal shank.

Due to the provision of a second lower rib in accordance with the invention, an upper and lower flange for the needle shank is provided which are connected with each other at their ends by the guide portions. Therefore, it is quite obvious that this provides a considerable strengthening of the needle stability. This is a surprising result, because in contrast to the concept of German Offenlegungsschrift 28 20 925, the second lower rib which engages the base of the needle guide groove in the assembled condition does not interfere with the bending oscillations in the upper rib, so that the protection of the needle hook from the control drives is assured.

In accordance with a further embodiment of the invention, a cut-out or opening between the upper rib and the lower rib is subdivided into longitudinal segments of about 8 mm in length by at least one connecting member. This is particularly advantageous for especially long knitting tools.

The arrangement of longitudinal cut-out segments in the shank of a latch needle between the operating foot and the design foot is already known from German Offenlegungsschrift 17 60 336. However, in this reference, there cut-outs are provided for reducing the weight of the needle.

From U.S. Pat. No. 4,036,036, a latch needle is known wherein the control drives exerted on the needle foot or butt are absorbed and vibrations are dampened in that slots or cut-outs are provided in the needle shaft which extend into the needle foot (see, in particular, the claims of this reference). Also, this reference warns that no weakening of the stability of the needle should occur, but no suggestion is made to convert the control drives which are exerted on the needle foot into bending oscillations. This is achieved in the present invention by making the connecting part sufficiently thin, so that it is easily bent.

BRIEF DESCRIPTION OF THE DRAWING

Other objects and features of the present invention will become apparent from the following detailed description when taken in connection with the accompanying drawing which discloses three embodiments of the invention. It is to be understood that the drawing is designed for the purpose of illustration only and is not intended as a definition of the limits of the invention.

In the drawing, wherein similar reference characters denote similar elements throughout the several views.

DESCRIPTION OF THE PREFERRED EMBODIMENTS

Figure 1:
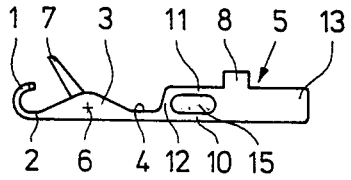
FIG. 1 is a schematic side elevational view of a needle embodying the resent invention, with a foot and a short follow-up segment.

Referring now in detail to the drawing, each latch needle contains a hook 1, a neck 2, a front or breast portion 3, a channel, groove or connecting portion 4 which is easily bendable, and a longitudinal shank portion 5 disposed adjacent thereto. A rotatable or pivotable axle 6 is provided in front portion 3 for a latch 7 whcih is mounted in a longitudinal slot parallel to the plane of the drawing, of the front portion 3 on the axle 6. Latch 7 closes or opens the thread space within hook 1. The shank portion 5 supports an operating foot or butt 8 and, if need be, a design or pattern foot or butt 9.

Figure 2:
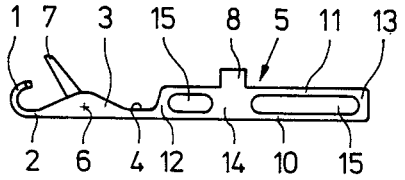
FIG. 2 is a schematic side elevational view of another embodiment of the invention comparable to that of FIG. 1, but showing a needle with a longer follow-up segment.
Figure 3:
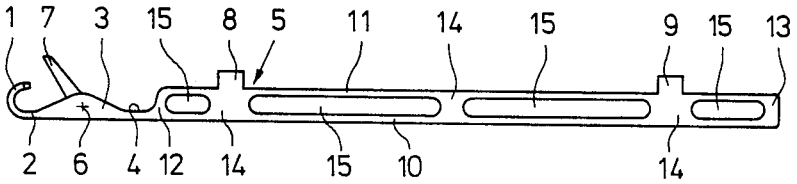
FIG. 3 is a schematic side elevational view of yet another embodiment of the invention comparable to that of FIG. 2, but showing a needle with two feet.

The shank portion 5 consists of a lower guidance rib 10 formed along the lower part of the shank portion 5 and of an upper guidance rib 11, near which the foot or the feet 8, 9 extend outwardly. The two guidance ribs 19 and 11 are connected with each other by guide portions 12, 13 at both ends of the longitudinal shank portion 5. A cut-out or opening 15 is provided between the two ribs 10 and 11. In the embodiments shown in FIGS. 2 and 3, the cut-out is separated by means of a connecting portion 14 into two longitudinal segments 15 which have a length of at least 8 mm, especially in the embodiments of greater length, as shown in FIGS. 2 and 3.

In all of the figures, the entire length of at least one opening 15 is shown as being positioned between the operating foot or butt 8 and the connecting portion 4 so that the opening 15 is offset from and does not extend beneath the operating foot or butt 8. Thus, the entire length of the opening 15 is positioned between the operating foot or butt 8 and the hook 1 to absorb vibrations transmitted to the shank 5 by the operating foot or butt 8. Also, as shown in all of the figures, the opening 15 is wider than either of the upper or lower flexible ribs 11, 10 and is greater than two times as long as the combined width of the upper and lower flexible ribs 11, 10. Ribs 10 and 11 have a height of at most 1.1 mm.

Thus, while only three embodiments of the present invention have been shown and described, it will be obvious that many changes and modifications may be made thereunto, without departing from the spriit and scope of the invention.

What is claimed is:

1. A stamped knitting needle for a knitting machine, said needle comprising:

a hooked needle;

at least one operating foot; and a shank portion having first and second ends, at least a portion of said shank supporting said foot, said shank including a longitudinally extending upper flexible rib having a width not greater than 1.1 mm., a longitudinally extending lower flexible rib having a width not greater than the width of said upper rib, a first guide portion at said first end of said shank, a second guide portion at said second end of said shank, said first and second guide portions interconnecting said upper and lower ribs and said upper and lower ribs defining an opening therebetween, said opening being wider than either of said upper or lower flexible ribs, said opening being greater than two times as long as the combined width of said upper and lower flexible ribs, and said opening being offset from said foot and positioned entirely between said foot and said needle hook to absorb vibrations transmitted to said shank by said operating foot.

* * * * *